United States Patent [19]
Zimmerman et al.
[11] 4,317,563
[45] Mar. 2, 1982

[54] BLOWING DEVICE IN SHEET DELIVERERS OF SHEET PROCESSING MACHINES

[75] Inventors: Hans Zimmerman, Coswig; Fritz Piper, Radebeul; Gerd Wierth; Hartmut Nagel, both of Coswig, all of German Democratic Rep.

[73] Assignee: VEB Kombinat Polygraph "Werner Lamberz" Leipzig, Leipzig, German Democratic Rep.

[21] Appl. No.: 115,284

[22] Filed: Jan. 25, 1980

[30] Foreign Application Priority Data

Feb. 14, 1979 [DD] German Democratic Rep. ... 211021

[51] Int. Cl.[3] ..... B65H 31/00
[52] U.S. Cl. ..... 271/211
[58] Field of Search ..... 271/309, 282, 195, 211

[56] References Cited

U.S. PATENT DOCUMENTS 3,556,519 1/1971 Keller ..... 271/211 X
3,624,807 11/1971 Schwebel ..... 271/195 X
3,727,911 4/1973 Vits ..... 271/195
4,168,831 9/1979 Rebel ..... 271/195 X

FOREIGN PATENT DOCUMENTS 901906 7/1962 United Kingdom ..... 271/211

*Primary Examiner*—Richard A. Schacher
*Attorney, Agent, or Firm*—Michael J. Striker

[57] ABSTRACT

A blowing arrangement for a sheet-delivering device of a sheet-processing machine has a plurality of blowing nozzles arranged to be located above a sheet-delivering device and spaced from one another in a direction which is transverse to the sheet-transportation direction and at an angle to the sheet-transportation plane so as to blow air contrary to the sheet-transportation direction and between a sheet placed in the sheet stack and a sheet transported to the latter, wherein the blowing nozzles are also arranged at diverging angles to the sheet-transportation direction as considered in the sheet-transportation plane.

10 Claims, 3 Drawing Figures

BLOWING DEVICE IN SHEET DELIVERERS OF SHEET PROCESSING MACHINES

BACKGROUND OF THE INVENTION

The invention relates to a blowing device of sheet deliverers of sheet processing machines, particularly printing machines. In sheet processing machines, for example in printing machines, the sheet deliverer will remove the sheets after printing by means of gripper carriages, transport these over a stack where they are released and placed upon the stack. Forming of the stack is aided by pneumatic systems, used preferably with high-speed machines and large sheet sizes.

By the patent application designated DD-WP B 65 h /208,953, a pneumatic device to aid in stack forming has become known. The device consists of longitudinal blow tubes above the stack, by which the sheet to be stacked is partially impinged from above by blown air, this in order to expel the air cushion between the upper edge of the stack and the sheet. Suction elements are, furthermore, provided at the lateral zones of the rear edge of the stack, serving to evacuate the air between the stack and the sheet. The suction elements serve for the rapid moving of the rear edge of the stacking sheet out of the sheet path, since the former can be influenced only to an insufficient degree by the air blown at the top. This device has the disadvantage that the relative motion between the stacking sheet and the transported sheet above it will cause a reduction of air pressure between these sheets relative to the prevailing air pressure below the stacking sheet, thus causing a reduction in the fall velocity of the stacked sheet, this pressure differential being difficult to remove.

In consequence of the pressure differential still remaining, the end of the stacking sheet may even be pulled towards the transported sheet and be dragged along by the latter so that no exact stack can be formed.

Furthermore, the suction chests will evacuate air from a space which is not clearly defined, since air from the free space may flow in at the particularly endangered sheet corners, thus reducing the efficacy of the device. The further disadvantage of this device is that it can be produced and operated only at relatively high expenditure.

SUMMARY OF THE INVENTION

It is the objective of the invention to create a blowing device in sheet deliverers that may be produced and operated at low expenditure and will enable formation of exact stacks also at high speeds by preventing curling of the rear edge of the stacking sheet.

It is the task of the invention to create a blowing device for sheet deliverers, allowing removal of the relative pressure differential between the stacking sheet and the sheet transported above the stack, and also enabling flattening of the sheet corners at the rear edge.

As per invention, this task is resolved by arranging above the stack, and across the width of the sheet, blow nozzles blowing a stream of air at a small angle, onto the rear sheet zones and against the direction of sheet transport, the air stream impinging between the stacking sheet and the transported sheet. The blow nozzles will herein be preferably arranged nearly at the center of the stack.

The nozzles are arranged in the plane of sheet transport at an angle increasing when viewed from the inside towards the exterior, this measure further increasing the efficacy of reducing the pressure differential in the zone of the rear edges of the sheet.

The task is furthermore also resolved by adjusting the quantity of blown air with a throttle valve. The blow nozzles are arranged pivotable in the plane of the sheet transport, with an adjusting linkage and a worm drive operable by a hand lever provided appurtenant to the blow nozzles.

This device enables to blow a stream of air variable as to volume and velocity at the rear zone of the sheet, between the stacking sheet and the transported sheet, thus preventing the formation of a pressure differential between these two sheets. It will be avoided thereby that the stacking sheet is drawn toward the transported sheet and pulled along by it.

The air, fanlike directed from the inside outward over the zone of the stack will not only flatten the rear sheet edges but also, in an advantageous manner, remove difficulties caused by sheet corners when stacking the sheet. The device has small air requirements, with positive air control, since the action of the blown air onto the stacking sheet is interrupted by the transported sheet when the latter passes through the zone where the air is applied.

The device will affect only the respective stacking and/or transported sheet so that air turbulence cannot, for instance, exert a negative influence upon the prearranged sheet already in the stack-forming phase. The device can be adjusted as to sheet size, typography and sheet material; it can be produced and operated by simple means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
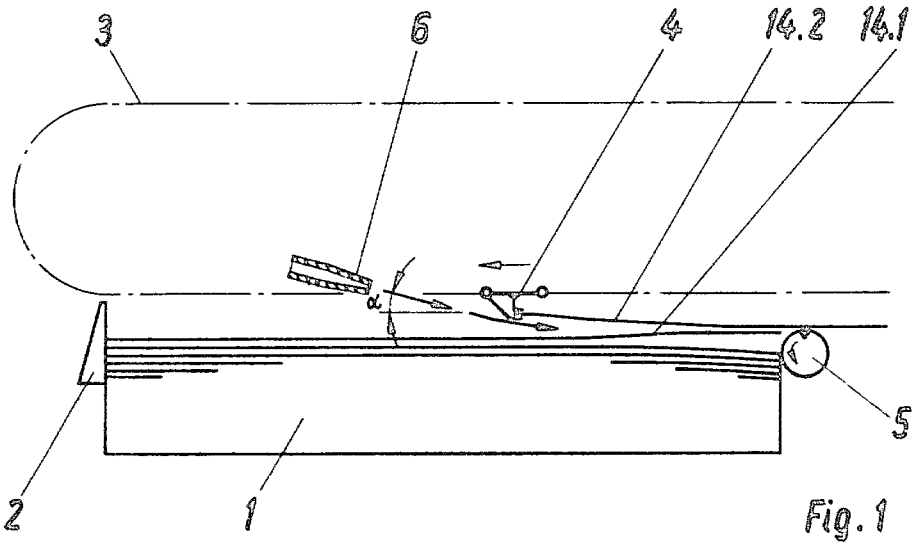
FIG. 1 is a side view of solution of a blowing arrangement as per the present invention.

FIG. 1 shows in a side view the stack 1 of a sheet deliverer of a sheet-processing machine, with sheet stops 2 arranged at the front edge of the stack. Gripper carriages 4 (only one shown) are attached to an endless chain 3 above the stack 2. A suction roller 5 is arranged at the rear edge of the stack.

Two or more blow nozzles 6 are arranged at a small angle $\alpha$ to the sheet path, transversal to the width of the stack 1, between the endless chain 3 above the sheet-transport path.

Figure 3:
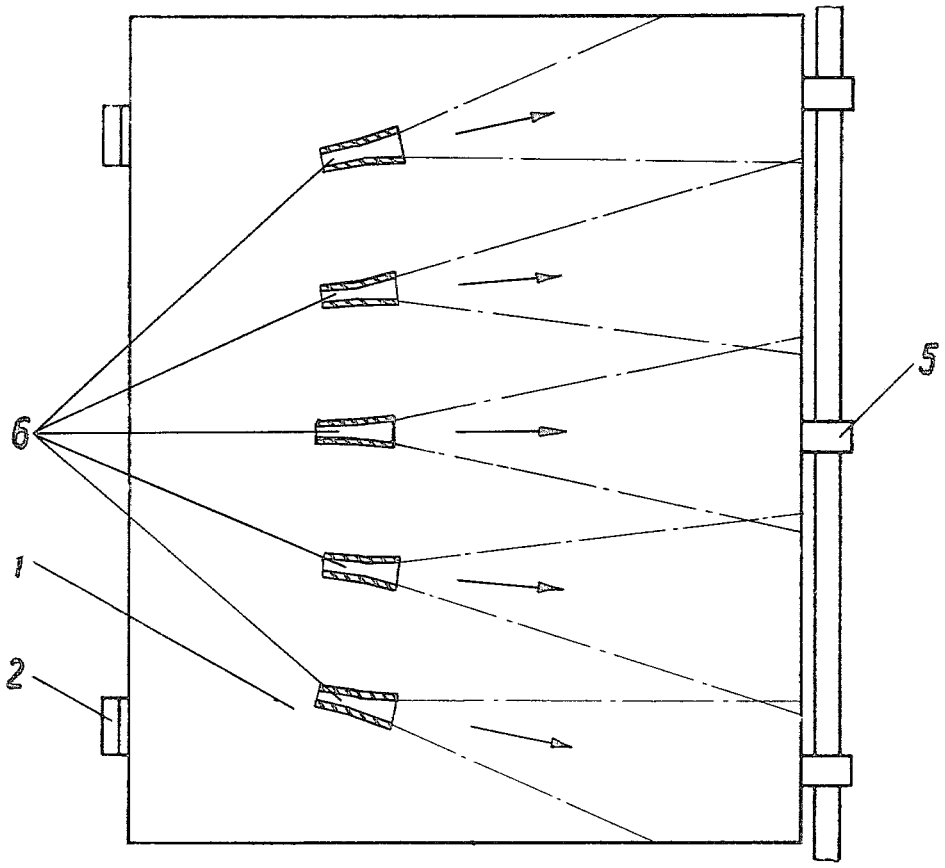
FIG. 3 is a top view of the flowing arrangement in accordance with another embodiment of the invention.
Figure 2:
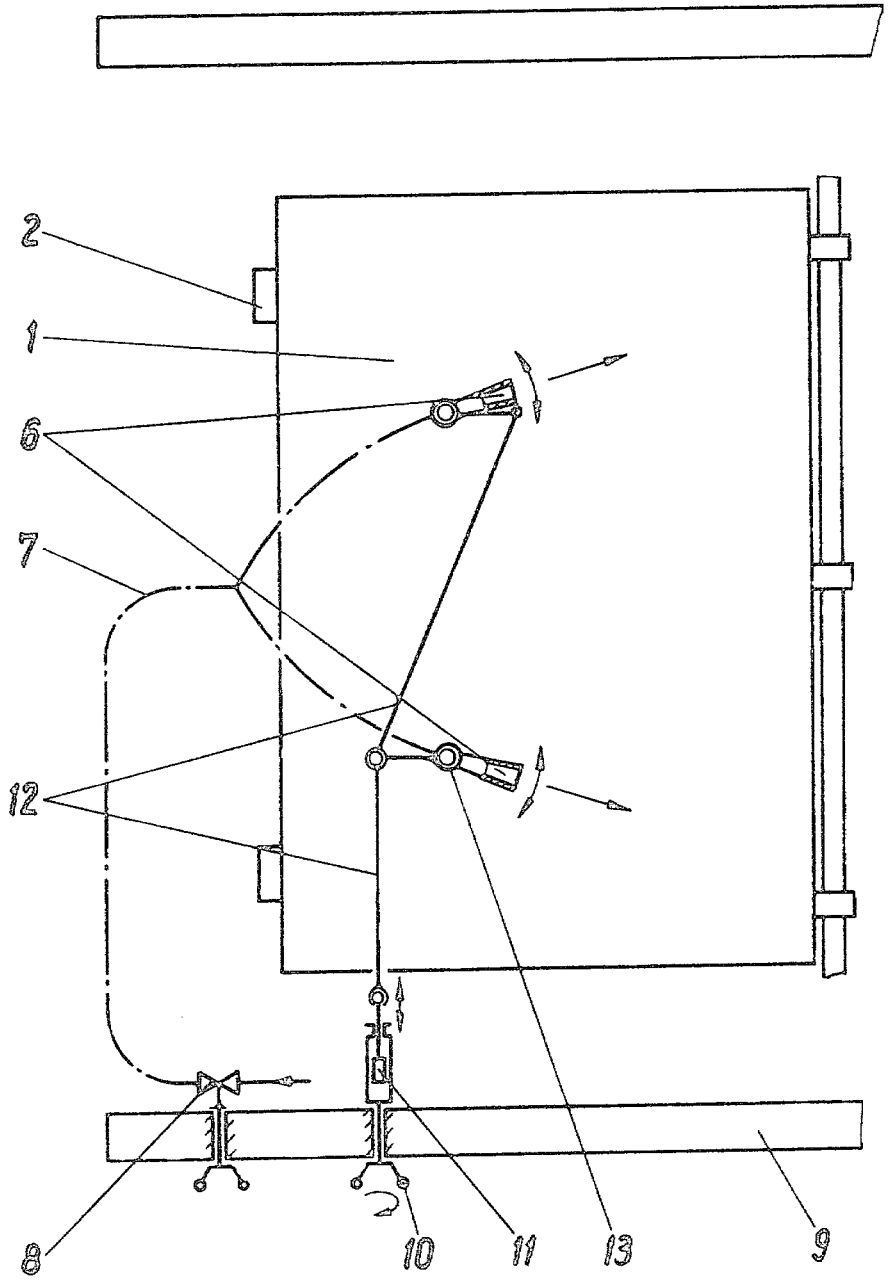
FIG. 2 is a top view of the arrangement of FIG. 1.

As shown in the drawings, the blow nozzles 6 are preferably located at or, respectively, near the center of the stack. The blow nozzles 6 are oriented toward the rear zones of the sheet, wherein, as shown in FIG. 3, the blow nozzles in the plane of the stack are of an increasing angular arrangement, from the interior to the exterior. The blow nozzles 6 are connected by hoses 7 and a throttle valve 8 to an air supply (not shown), and are attached by brackets (not shown) to the side wall 9 of the sheet deliverer, with pivoting of the blow nozzles 6 in the plane of the pivot 13 being effected by a hand lever 10 supported in the side wall 9, a worm drive 11, and an adjusting linkage 12.

Operation of the device is as follows:

The sheets 14 are continually transported by the gripper carriage 4 above the delivered stack 1, released there and stacked. Aligning by the front edge is effected herein at the sheet stops 2.

Stacking is aided by the stream of air exiting at an angle $\alpha$ from the blow nozzles 6 and blown on the sheet 14. The blow nozzles 6 are arranged in the plane of the sheet transportation at an angle increasing from the interior to the exterior, this in order to ensure flattening of the sheet edges. The angle of the blow nozzles is adjustable by means of a hand lever 10, a worm drive 11 and an adjusting linkage 12. The air is permanently blown onto the sheet, it is, however, also possible to apply it in cycles. In cyclewise control, the blown air is turned on when the gripper carriage 4 with the transported sheet 14.2 has passed the suction roll 5 and it is turned on after the gripper carriage 4 has passed over the stream of blown air.

It will be understood that each of the elements described above, or two or more together, may also find a useful application in other types of constructions differing from the types described above.

While the invention has been illustrated and described as embodied in an air blowing arrangement for a sheet-delivering device of a sheet-processing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

1. A blowing arrangement for a sheet-delivering device of a sheet-processing machine, such as a printing machine, wherein sheets are transported to a sheet stack in predetermined direction and plane, the blowing device comprising a plurality of blowing nozzles arranged to be located above a sheet-delivering device receiving a sheet-stack and spaced from one another in a direction which is transverse to the sheet-transportation direction, said blowing nozzles being arranged at diverging angles to the sheet-transportation direction as considered in the sheet transportation plane, at an angle to the sheet-transportation plane, and offset from a front zone of the sheet stack toward a rear zone thereof so as to blow an air stream inclined in two planes and directed into the rear zone of the sheet stack, contrary to the sheet transportation direction and between a sheet placed in the sheet stack and a sheet transported to the latter, to thereby act upon these sheets in the region of a rear edge and rear corners of the sheet stack.

2. A blowing arrangement as defined in claim 1, wherein the sheets in the sheet stack have corner regions, said blowing nozzles being arranged so that air exiting from said blowing nozzles overlaps the corner regions of the sheet in the sheet stack.

3. A blowing arrangement as defined in claim 1, wherein the sheet stack has a center line extending in the sheet-transportation direction, said blowing nozzles being arranged at different diverging angles to the center line of the sheet stack so that the blowing nozzles arranged farther from the center line are arranged at greater diverging angles.

4. A blowing arrangement as defined in claim 1, wherein the sheet stack has a central region as considered in the sheet-transportation direction, said blowing nozzles being arranged to be located in the central region of the sheet stack.

5. A blowing arrangement as defined in claim 1, wherein the sheet stack has a central region as considered in the sheet-transportation direction, said blowing nozzles being arranged to be located adjacent to the central region of the sheet stack.

6. A blowing arrangement as defined in claim 1; and further comprising means for adjusting air to be blown by said blowing nozzles.

7. A blowing arrangement as defined in claim 6, wherein said air adjusting means includes a throttle valve connected with said blowing nozzles.

8. A blowing arrangement as defined in claim 1; and further comprising means for pivoting said blowing nozzles in the sheet-transportation plane.

9. A blowing arrangement as defined in claim 8, wherein said pivoting means includes a hand-operated worm drive.

10. A blowing arrangement as defined in claim 9, wherein said pivoting means further includes a linkage connecting said worm drive with said blowing nozzles, and a hand lever actuating said worm drive.

* * * * *